US005979017A

United States Patent [19]

Karl

[11] Patent Number: 5,979,017

[45] Date of Patent: Nov. 9, 1999

[54] FASTENER SYSTEM FOR MOUNTING A FURNITURE FITTING

[75] Inventor: Reinhard Karl, Schwerzach, Austria

[73] Assignee: Grass AG, Austria

[21] Appl. No.: 09/099,043

[22] Filed: Jun. 17, 1998

[51] Int. Cl.[6] ..... E05D 5/00

[52] U.S. Cl. ..... 16/383; 16/382

[58] Field of Search ..... 16/382, 383, 258; 411/60, 55, 51, 50, 33, 32, 15

[56] References Cited

U.S. PATENT DOCUMENTS

| | | | |
|---|---|---|---|
| 4,021,881 | 5/1977 | Lautenschlager | 16/383 |
| 5,246,322 | 9/1993 | Salice | 411/57 |
| 5,561,888 | 10/1996 | Lautenschlager | 16/383 |
| 5,577,297 | 11/1996 | Lautenschlager et al. | 16/383 |
| 5,586,364 | 12/1996 | Ferrari et al. | 16/383 |
| 5,669,108 | 9/1997 | Ferrari et al. | 16/383 |
| 5,711,054 | 1/1998 | Salice | 16/382 |
| 5,715,577 | 2/1998 | Lautenschlager et al. | 16/383 |
| 5,725,342 | 3/1998 | Gehrer | 411/33 |

*Primary Examiner*—Chuck Y. Mah
*Attorney, Agent, or Firm*—John M. Harrington; Kilpatrick Stockton LLP

[57] ABSTRACT

A fastener system for mounting a furniture fitting includes a pair of spreader dowels supported in corresponding holes in the fastening flange of a furniture fitting. Each spreader dowel includes an expandable dowel with an inner notch and a noncircular spreader screw within the inner notch. The spreader screw expands the dowel with a 90-degree turn of the spreader screw, and each spreader screw is provided with a cover cap from which a crank extends. The respective dowels are expanded by rotating the respective cranks through a 90-degree turn from a position substantially parallel to one another to a position overlapping one another.

5 Claims, 3 Drawing Sheets

FASTENER SYSTEM FOR MOUNTING A FURNITURE FITTING

BACKGROUND OF THE INVENTION:

1. Field of the Invention

The present invention relates to a fastening system for mounting a furniture fitting on a furniture article and, more particularly, to a fastener system for mounting a furniture hinge on a desk or cabinet.

2. Description of the Prior Art

Various types of fastener systems for mounting a furniture fitting on a furniture article have been used in the furniture and cabinetry industry for many years. One such device is known from U.S. Pat. No. 5,725,342, known as a spreader dowel, which is supported in a fastening flange of the furniture fitting and which includes an expandable dowel with an inner notch and a non-circular spreader screw which is rotatable within the inner notch. The spreader screw expands or spreads the dowel with a slight right-hand or left-hand twist of the spreader screw, and the spreader screw is provided with a slotted or socketed head to accommodate turning the screw with a tool, such as a screwdriver. A disadvantage of such prior art fastener system is the necessity of providing the tool with which to turn the spreader screw and thereafter affixing a cover cap to conceal the head of the spreader screw.

SUMMARY OF THE INVENTION

The general purpose of the present invention, which will be described subsequently in greater detail, is to provide a new and improved fastener system for mounting a furniture fitting on a furniture article, such as a cabinet or desk, without the use of a tool, that has all of the advantages of prior art fastener systems and none of the disadvantages. In order to attain this purpose, a representative embodiment of the present invention is illustrated in the drawings. The fastener system of the present invention makes use of a fastening flange formed on a hinge cup of the furniture fitting, for example, a furniture hinge. The fastening flange has at least one opening and preferably a pair of openings formed therein in each of which a spreader dowel is supported. The spreader dowel is of a type described in U.S. Pat. No. 5,725,342, the disclosure of which is incorporated herein by this reference, which includes an expandable dowel with an inner notch and a non-circular spreader screw within the inner notch. The spreader screw expands or spreads the dowel with a slight right-hand or left-hand twist of the spreader screw, depending on whether the spreader screw is provided with a right-hand or left-hand thread convolution in the area of the shaft of the spreader screw. In the particular type of spreader dowel, the spreader screw is also provided with projections which cooperate with corresponding shoulders formed in the fastening flange opening to limit rotation of the fastening screw to about 90 degrees or one-quarter turn between unexpanded and expanded conditions of the dowel. Advantageously, the fastener system of the present invention includes a crank extending from the upper end of each spreader screw which is operable to twist or rotate the respective spreader screws within the inner notch to expand the respective dowels. Further, each spreader screw is provided with a cover cap formed on its upper end, and the respective cranks extend from the respective cover caps. Further, the spreader screw of one of the first and second spreader dowels is provided with a right-hand thread convolution in the area of the shaft of the spreader screw, and the other spreader screw of the first and second spreader dowels is provided with a left-hand thread convolution in the shaft area. Accordingly, the respective dowels of the first and second spreader dowels are expanded or spread by rotating the respective cranks and connected cover caps and their associated spreader screws in directions opposite to one another. In other words, the respective dowels are expanded by rotating the respective cranks through a 90-degree twist or quarter turn from a position substantially parallel to one another corresponding to an unexpanded condition of the respective dowels to a position substantially overlapping one another to a position corresponding to an expanded condition of the respective dowels.

In order to accommodate the overlappage of the respective cranks and to provide an aesthetically appealing appearance, one of the cranks is made slightly larger than the other crank and is provided with a recess to receive or nest the other crank. Thus, the overlapping cranks, together with their respective associated cover caps present a smooth, uniform, pleasing appearance in which the cover caps and overlapping cranks simulate the appearance of a one-piece continuous cover. The furniture fitting comprises a furniture hinge which includes a hinge cup that is insertable in a corresponding predrilled bore hole in the furniture article, and the respective dowels are likewise designed to be inserted in corresponding pre-drill bore holes in an unexpanded condition with associated cranks extending parallel to one another. Thereafter, one of the cranks is rotated to expand its associated dowel, which thereby locks the dowel in its corresponding bore hole, and the second crank is then likewise rotated in the opposite direction to expand its associated dowel, which thereby likewise locks the second dowel in its corresponding bore hole. Thus, the hinge cup can be securely mounted to the furniture article without the use of a tool such as a screwdriver. The hinge cup is also provided with pivot means, such as a pivot pin, on which a hinge arm is pivoted, and the hinge arm can be attached to another portion of the furniture article, such as a supporting frame. Likewise, in order to easily remove the hinge cup from the furniture article, the respective cranks may be rotated in the reverse directions, respectively, to return the dowels to the unexpanded condition in which the dowels are no longer locked into their respective bore holes.

The foregoing focuses on the more important features of the invention in order that the detailed description which follows may be better understood and in order that the present contribution to the art may be better appreciated. There are, of course, additional features of the invention which will be described hereinafter and which will form the subject matter of the claims appended hereto. It is to be understood that the invention is not limited in its application to the details of construction and to the arrangement of the components set forth in the following description and drawings. The invention is capable of other embodiments and of being practiced and of being carried out in various ways.

It is to be further understood that the phraseology and terminology employed herein are for the purpose of description and are not to be regarded as limiting. Those skilled in the art will appreciate that the conception on which this disclosure is based may readily be used as a basis for designing the structures, methods, and systems for carrying out the special purposes of the present invention. The claims are regarded as including such equivalent constructions so long as they do not depart from the spirit and scope of the present invention.

From the foregoing summary, it is apparent that an object of the present invention is to provide a new and improved fastening system for mounting a furniture fitting, such as a hinge, on a furniture article, such as a desk or cabinet which has all of the advantages, and more, of prior art devices and none of the disadvantages.

It is another object of the present invention to provide a new and improved fastener system for mounting a furniture fitting on a furniture article that is more reliable and functional than those previously available.

Yet, another object of the present invention is to provide a new and sophisticated, precision-made fastener system for mounting a furniture hinge on a furniture article without use of a tool.

These, together with other objects of the present invention, along with the various features of novelty which characterize the invention, are pointed out with particularity in the claims annexed to and forming a part of this document.

For a better understanding of the invention, its operating advantages, and the specific objects attained by its uses, reference should be made to the accompanying drawings in which like characters of reference designate like parts throughout the several views.

BRIEF DESCRIPTION OF THE DRAWING

This invention will be better understood and, objects other than those set forth above, will become apparent when consideration is given to the following detailed description. Such description makes reference to the annexed drawings wherein.

DESCRIPTION OF THE PREFERRED EMBODIMENT

Figure 1:
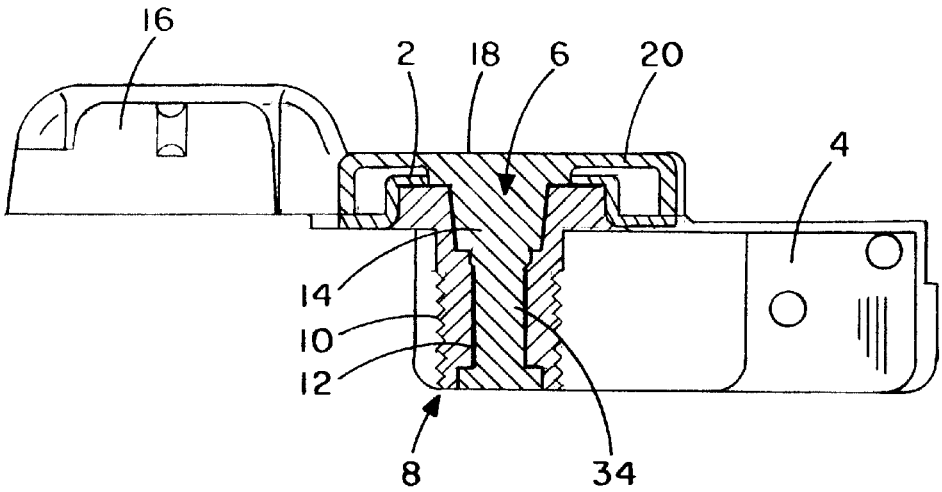
FIG. 1 is a partial sectional side elevational view of a hinge cup with the fastener system of the present invention.

Referring now to the drawings and particularly to FIG. 1, the fastener system of the present invention is used for mounting a furniture fitting, for example, a furniture hinge on a furniture article such as a desk or cabinet and makes use of a fastening flange 2 formed, for example, on a hinge cup 4 of the furniture hinge. Fastening flange 2 has at least one opening 6 formed therein in which a spreader dowel 8 is supported. Spreader dowel 8, shown schematically in FIG. 1, is of a type described in U.S. Pat. No. 5,725,342, the disclosure of which is incorporated herein by this reference, which includes an expandable dowel 10 with an inner notch 12 and a non-circular spreader screw 14 within inner notch 12, and wherein spreader screw 14 expands or spreads dowel 10 with a slight right-hand or left hand twist of spreader screw 14, depending on whether spreader screw 14 is provided with a right-hand or left-hand thread convolution. In the particular type of spreader dowel, the spreader screw is provided with projections which cooperate with corresponding shoulders formed in the fastening flange opening to limit rotation of the fastening screw to about 90 degrees between unexpanded and expanded conditions of the dowel. Referring also to FIG. 1, the fastener system of the present invention includes a crank 16 extending from upper end 18 of spreader screw 14 which is operable to twist or rotate spreader screw 14 within inner notch 12 to expand dowel 10. Further, spreader screw 14 is provided with a cover cap 20 formed on its upper end 18, and crank 16 extends from cover cap 20.

Figure 2:
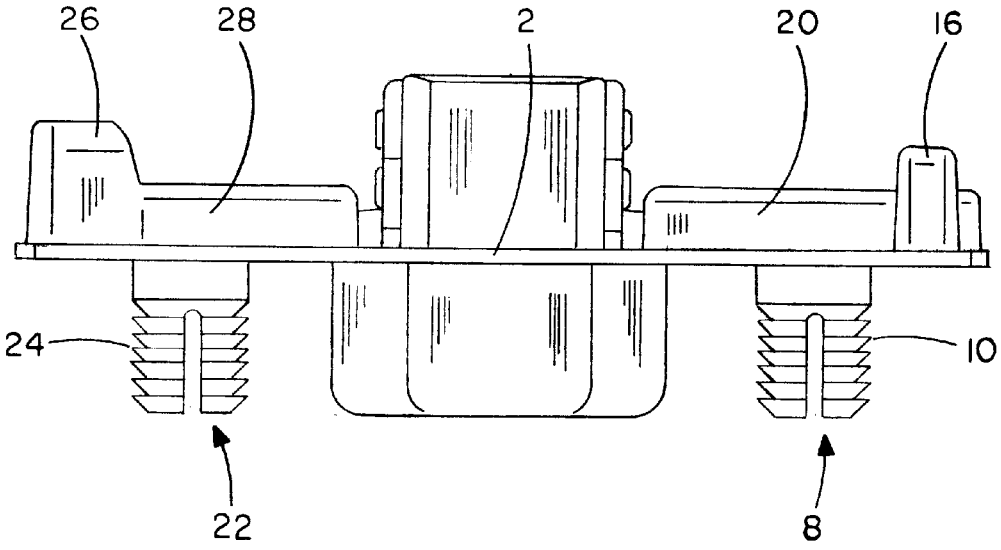
FIG. 2 is a front elevational view of a hinge with the fastener system of FIG. 1.
Figure 3:
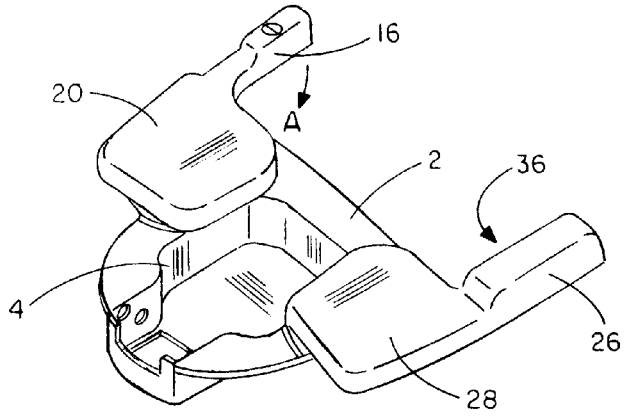
FIG. 3 is a perspective view of a hinge cup with the fastener system of FIG. 1 with the spreader screw cranks parallel to one another.
Figure 4:
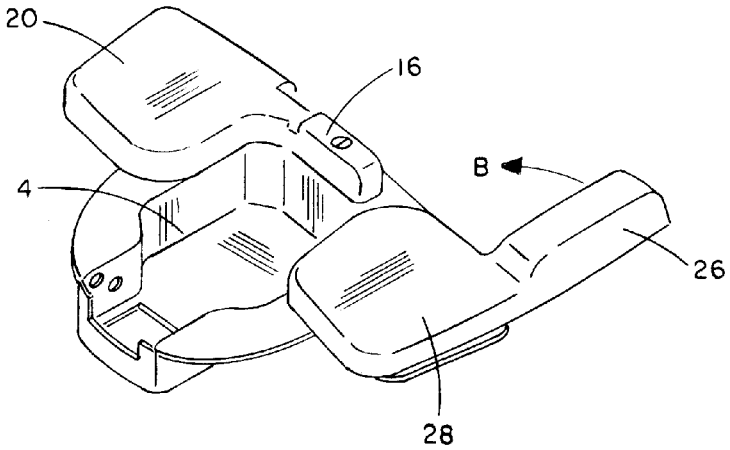
FIG. 4 is a perspective view of a hinge cup with the fastener system of FIG. 1 with one of the spreader screw cranks rotated 90 degrees.
Figure 5:
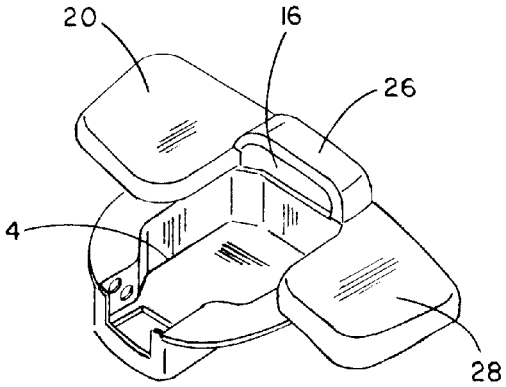
FIG. 5 is a perspective view of a hinge cup with the fastener system of FIG. 1 with both spreader screw cranks rotated 90 degrees.

In the preferred embodiment, fastening flange 2 is also provided with a second opening (not more particularly shown) identical to opening 6 shown in FIG. 1 but spaced apart from opening 6 and disposed on the opposing side of hinge cup 4. The second opening likewise supports a second spreader dowel shown generally in FIG. 2 as 22, which is similar to spreader dowel 8 and which likewise includes an expandable dowel 24 with an inner notch and a non-circular spreader screw within the inner notch, and wherein the spreader screw likewise expands or spreads dowel 24 with a slight right-hand or left-hand twist of the spreader screw, depending on whether the spreader screw is provided with a right-hand or left-hand thread convolution. The spreader screw of second spreader dowel 22 is also provided with a crank 26 as shown in FIGS. 3–5 which likewise extends from the upper end of the spreader screw of second spreader dowel 22, and which is likewise operable to rotate the spreader screw within the inner notch of second spreader dowel 22 to expand dowel 24. Further, the spreader screw of second spreader dowel 22 is likewise provided with a cover cap 28 formed on its upper end, and crank 26 extends from cover cap 28.

While second spreader dowel 22 is similar to spreader dowel 8, in the preferred embodiment, the spreader screw of one of first and second spreader dowels 8, 22 is provided with a right-hand thread convolution in the area of the shaft of the spreader screw, for example, in shaft area 34 of spreader screw 12, and the other of the spreader screw of first and second spreader dowels 8, 22 is provided with a left-hand thread convolution in the shaft area. Accordingly, the respective dowels 10, 24 of the first and second spreader dowels 8, 22 are expanded or spread by rotating respective cranks 16, 26 and connected cover caps 20, 28 and their associated spreader screws in directions opposite to one another. In other words, dowel 10 of first spreader dowel 8 is expanded by rotating crank 16 in arrow direction "A" as shown in FIG. 3, and dowel 24 of spreader dowel 22 is expanded by rotating crank 26 in arrow direction "B" as shown in FIG. 4, which is opposite to arrow direction "A". Moreover, as noted above, in the particular type of spreader dowel, the spreader screw expands the dowel with only a slight right-hand or left-hand twist of the spreader screw, depending on whether the spreader screw is provided with a right-hand or left-hand thread convolution. Further, in the particular type of spreader dowel, the spreader screw is provided with projections which cooperate with corresponding shoulders formed in the fastening flange opening to limit rotation of the fastening screw to substantially 90 degrees between unexpanded and expanded conditions of the dowel. Thus, in the present invention, dowels 10, 24 are expanded by rotating cranks 16, 26 respectively through a 90 degree twist or quarter turn from a position substantially parallel to one another as shown in FIG. 3, corresponding to an unexpanded condition of dowels 10, 24, to a position of cranks 16, 26 substantially overlapping one another as shown if FIG. 5 in an expanded condition of dowels 10, 24.

Figure 6:
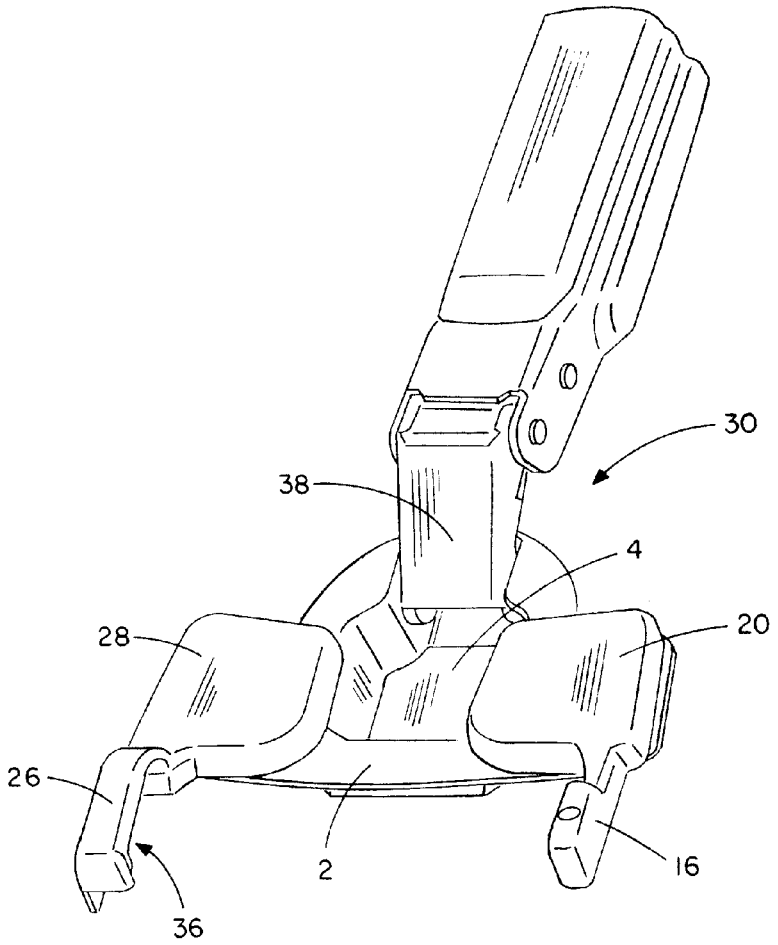
FIG. 6 is a perspective view of a hinge with the fastener system of FIG. 1 with the spreader screw cranks parallel to one another.
Figure 7:
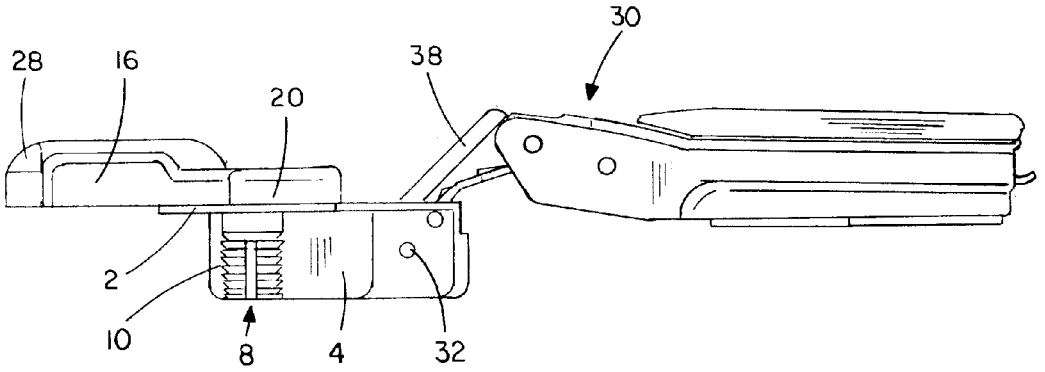
FIG. 7 is a side elevational view of a hinge with the fastener system of FIG. 1 with the spreader screw cranks parallel to one another.

In order to accommodate the overlappage of cranks 16, 26 and to provide an aesthetically appealing appearance, one of the cranks, for example, crank 26 is made slightly larger than the other crank 16, and is also provided with a recess 36 to receive or nest the other crank 16. Accordingly, overlapping cranks 16, 26, together with their respective associated cover caps 20, 28 present a smooth uniform pleasing appearance in which cover caps 20, 28 and overlapping or nesting cranks 16, 26 simulate the appearance of a one-piece continuous cover. In the preferred embodiment, the furniture fitting consists of a furniture hinge 30 as shown in FIG. 6–8 which includes hinge cup 4 which is insertable in a predrilled corresponding bore hole in a portion of a furniture article such as a desk or cabinet (not shown). Dowels 10, 24 are likewise designed to be inserted in corresponding predrilled bore holes in an unexpanded condition with associated cranks 16, 26 extending parallel to one another as shown in FIG. 3. Thereafter, crank 16 is rotated in arrow direction "A" as shown in FIG. 3 to expand dowel 10, which thereby locks itself in its corresponding bore hole, and second crank 26 is then rotated in arrow direction "B" as shown in FIG. 4 to expand dowel 24, which likewise thereby locks itself in its corresponding bore hole. Thus, hinge cup 4 can be securely mounted to a part of the furniture article such as a cabinet door without the use of tools such as a screwdriver. Hinge cup 4 is also provided with pivot means such as pivot pin 32, on which a hinge arm 38 is pivoted, and hinge arm 38 can be attached to another portion of the furniture article such as a supporting frame (not shown). Likewise, in order to easily remove hinge cup 4 from the furniture article, cranks 16, 26 may be rotated in directions opposite arrow directions "A" and "B" respectively to return dowels 10, 24 to the unexpanded condition in which the dowels are no longer locked into their respective bore holes.

With respect to the descriptions set forth above, optimum dimensional relationship of parts of the invention (to include variations in size, materials, shape, form, function, and manner of operation, assembly and use) are deemed readily apparent and obvious to those skilled in the art, and all equivalent relationships to those illustrated in the drawings and described in the specification are intended to be encompassed herein. The foregoing is considered as illustrative only of the principal of the invention, since numerous modifications and changes will readily occur to those skilled in the art. It is not intended to limit the invention to the exact construction and operation shown and described, and all suitable modifications and equivalents falling within the scope of the appended claims are deemed within the present inventive concept.

What is claimed is:

1. A fastener system for mounting a furniture fitting on a furniture article, comprising:

a furniture fitting element having a fastening flange with portions defining a first opening and a second opening spaced from the first opening;

a first spreader dowel supported in the first opening, the first spreader dowel including an expandable dowel with an inner notch and a spreader screw, having a right-hand thread convolution, within the inner notch rotatable to expand the dowel;

a first cover cap formed on the upper end of the spreader screw of the first spreader dowel;

a first crank extending from the first cover cap operable to rotate the spreader screw of the first spreader dowel;

a second spreader dowel supported in the second opening the second spreader dowel including an expandable dowel with an inner notch and a spreader screw, having a left-hand thread convolution within the inner notch rotatable to expand the dowel;

a second cover cap formed on the upper end of the spreader screw of the second spreader dowel;

second crank extending from the second cover cap operable to rotate the spreader screw of the second spreader dowel;

wherein the respective dowels of the first and second spreader dowels are expanded by rotating the respective cranks and connected cover caps and spreader screws substantially 90 degrees in directions opposite to one another and wherein the respective cranks overlap one another when rotated to expand the dowels of the respective first and second spreader dowels.

2. The fastener system according to claim 1, wherein one of the first and second cranks has portions defining a recess which receives the other of the first and second cranks when the respective cranks overlap one another.

3. The fastener system according to claim 2, wherein the furniture fitting element comprises a hinge cup.

4. The fastener system according to claim 3, wherein the hinge cup includes pivot means, and further comprising a hinge arm pivoted on the pivot means.

5. The fastener system according to claim 4, wherein the pivot means comprises a pivot pin fastened in the hinge cup.

* * * * *